US008534536B2

(12) United States Patent
Mueller et al.

(10) Patent No.: US 8,534,536 B2
(45) Date of Patent: Sep. 17, 2013

(54) SUBSTANTIALLY ROUND TRAY

(75) Inventors: Duane Mueller, Wausau, WI (US); Debora Renken, Cottonwood, MN (US); Bernd A. Schneider, Wausau, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/277,924

(22) Filed: Oct. 20, 2011

(65) Prior Publication Data

US 2012/0097573 A1 Apr. 26, 2012

Related U.S. Application Data

(60) Provisional application No. 61/405,305, filed on Oct. 21, 2010.

(51) Int. Cl.
*B65D 1/34* (2006.01)

(52) U.S. Cl.
USPC ..... 229/109

(58) Field of Classification Search
USPC ..... 229/100, 109, 120, 903
See application file for complete search history.

(56) References Cited

U.S. PATENT DOCUMENTS

| | | | | |
|---|---|---|---|---|
| 1,894,209 | A * | 1/1933 | Wikstrom | 493/167 |
| 2,028,276 | A * | 1/1936 | Evans | 229/109 |
| 4,054,241 | A | 10/1977 | Meyers et al. | |
| 4,124,160 | A | 11/1978 | Meyers | |
| 4,166,567 | A | 9/1979 | Beach, Jr. et al. | |
| 4,283,427 | A | 8/1981 | Winters et al. | |
| 4,305,543 | A | 12/1981 | Lai | |
| 4,418,861 | A | 12/1983 | McFarland et al. | |
| 4,607,785 | A | 8/1986 | Croley | |
| 4,676,429 | A | 6/1987 | Crowe et al. | |
| D290,813 | S | 7/1987 | Forbes, Jr. | |
| 4,765,534 | A | 8/1988 | Zion et al. | |
| 4,943,456 | A | 7/1990 | Pollart et al. | |
| 5,002,826 | A | 3/1991 | Pollart et al. | |
| 5,118,747 | A | 6/1992 | Pollart et al. | |
| 5,247,149 | A | 9/1993 | Peleg | |

(Continued)

FOREIGN PATENT DOCUMENTS

| | | |
|---|---|---|
| JP | 6293334 | 10/1994 |
| JP | 7040968 | 2/1995 |
| JP | 2001247122 | 9/2001 |
| WO | WO 2007/127371 | 11/2007 |

OTHER PUBLICATIONS

A bottom pictorial view of prior art tray (Exhibit I), wherein view from opposite side is substantially a mirror image.

(Continued)

*Primary Examiner* — Steven A. Reynolds
*Assistant Examiner* — King M Chu
(74) *Attorney, Agent, or Firm* — Womble Carlyle Sandrige & Rice LLP

(57) ABSTRACT

More than four sidewalls extend upwardly and outwardly from a periphery of a central base panel of a tray. Each sidewall includes opposite first and second marginal portions extending outwardly from the base panel. For each adjacent pair of sidewalls of the plurality of sidewalls, the first marginal portion of a first sidewall of the adjacent pair of sidewalls is in an overlapping relationship with, and is fastened to, the second marginal portion of a second sidewall of the adjacent pair of sidewalls.

37 Claims, 9 Drawing Sheets

(56) References Cited

U.S. PATENT DOCUMENTS

| | | | | |
|---|---|---|---|---|
| 5,326,021 | A | 7/1994 | Farrell | |
| 5,410,135 | A | 4/1995 | Pollart et al. | |
| 5,412,187 | A | 5/1995 | Walters et al. | |
| 5,530,231 | A | 6/1996 | Walters et al. | |
| 5,718,368 | A * | 2/1998 | Rench et al. | 229/109 |
| 5,762,225 | A * | 6/1998 | Byrd | 220/6 |
| 5,948,308 | A * | 9/1999 | Wischusen, III | 219/730 |
| D437,557 | S | 2/2001 | Ingelin et al. | |
| 6,204,492 | B1 | 3/2001 | Zeng et al. | |
| 6,359,272 | B1 * | 3/2002 | Sadek et al. | 219/732 |
| 6,371,363 | B1 | 4/2002 | Franklin et al. | |
| 6,433,322 | B2 | 8/2002 | Zeng et al. | |
| 6,552,315 | B2 | 4/2003 | Zeng et al. | |
| 6,677,563 | B2 | 1/2004 | Lai | |
| 7,017,797 | B2 * | 3/2006 | Goglio | 229/125.17 |
| 7,328,833 | B1 | 2/2008 | Wiley | |
| 7,648,059 | B2 | 1/2010 | Pavlu, Jr. et al. | |
| 2001/0032843 | A1 * | 10/2001 | Aronsson et al. | 219/730 |
| 2004/0234653 | A1 * | 11/2004 | Cogley et al. | 426/107 |
| 2005/0184066 | A1 * | 8/2005 | Brooks et al. | 219/730 |
| 2006/0006215 | A1 * | 1/2006 | Chen | 229/186 |
| 2007/0056962 | A1 | 3/2007 | Hopkins, Sr. et al. | |
| 2007/0262487 | A1 | 11/2007 | O'Hagan et al. | |
| 2008/0035634 | A1 | 2/2008 | Zeng et al. | |
| 2010/0102111 | A1 | 4/2010 | Learn | |

OTHER PUBLICATIONS

A top pictorial view of prior art tray (Exhibit I), wherein view from opposite side is substantially a mirror image.

A bottom pictorial view of prior art tray (Exhibit II), wherein view from opposite side is substantially a mirror image.

A top pictorial view of prior art tray (Exhibit II), wherein view from opposite side is substantially a mirror image.

International Search Report for PCT/US2011/056817 mailed Apr. 27, 2012.

Written Opinion for PCT/US2011/056817 mailed Apr. 27, 2012.

* cited by examiner

SUBSTANTIALLY ROUND TRAY

CROSS-REFERENCE TO RELATED APPLICATION

This application claims the benefit of U.S. Provisional Patent Application No. 61/405,305, which was filed Oct. 21, 2010.

INCORPORATION BY REFERENCE

The entire disclosure of U.S. Provisional Patent Application No. 61/405,305, which was filed Oct. 21, 2010, is incorporated herein by reference.

TECHNICAL FIELD

The present disclosure relates to trays and, more particularly, to trays with more than four upright side walls.

BACKGROUND

A wide variety of trays are known. There is always a desire for new trays that provide a new balance of properties.

BRIEF SUMMARY

One aspect of this disclosure is the provision of a substantially round tray that may be formed from a paperboard blank having a substantially round, central base panel and a series of flaps connected to, and extending around, the periphery of the base panel. There may be more than four of the flaps, and in one specific example there are eight of the flaps, although there may be different numbers of flaps. The blank may be substantially octagonal.

For helping to facilitate folding of the flaps relative to the base panel, the blank may include at least one line of disruption (e.g., a substantially annular hinge line) that extends at least partially around the base panel and provides hinged connections between the periphery of the base panel and the inner edges of the flaps.

In the blank, adjacent flaps may be separated from one another, such as by outwardly extending cuts. In one specific example, the adjacent flaps are separated from one another by slits that extend outwardly from proximate the hinge line. Each flap includes opposite side margins that extend outwardly from the inner edge of the flap to an outer edge of the flap. The flaps may be folded upwardly and inwardly so that side margins of adjacent flaps overlap. The overlapping side margins may be fastened together, such as with adhesive material. For each overlap, the amount of the overlap may increase in the upward/outward direction.

The flaps may vary in the circumferential direction of the blank/tray, such as by being differently sized and/or differently shaped. In one specific example, the flaps may circumferentially alternate between relatively small flaps and relatively large flaps. In addition, the small flaps may be generally rectangular, whereas each of the large flaps may be substantially inwardly tapered. The outer corners of the large flaps may define acute angles that may optionally be chamfered or otherwise shaped in a manner that seeks to provide a substantially smooth and/or slightly undulating rim (e.g., upper edge) of the tray. Differently configured flaps are within the scope of this disclosure. For example, all of the flaps may be more alike, so that they are all substantially alike in the circumferential direction.

Whereas the tray is substantially round in some embodiments of this disclosure, the tray may be shaped differently in other embodiments of this disclosure.

In accordance with one aspect of this disclosure, the peripheral edge of the base panel of the tray may be characterized as comprising more than four peripheral edges, such as eight peripheral edges. The flaps form sidewalls that may extend both outwardly and upwardly from the periphery of the base panel. There are more than four of the sidewalls, such as eight of the sidewalls, that may be respectively connected to the peripheral edges of the base panel. Each of the sidewalls includes opposite first and second marginal portions extending outwardly from the base panel. For each adjacent pair of sidewalls, the first marginal portion of a first sidewall of the adjacent pair of sidewalls is in an overlapping relationship with, and is fastened to, the second marginal portion of a second sidewall of the adjacent pair of sidewalls.

The foregoing presents a simplified summary of some aspects of this disclosure in order to provide a basic understanding. The foregoing summary is not an extensive summary and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are not necessarily drawn to scale, and wherein.

DETAILED DESCRIPTION

Referring now in greater detail to the drawings, in which like numerals refer to like parts throughout the several views, exemplary embodiments are described in the following. For example, a blank 20 and substantially round tray 22 of a first embodiment are shown in FIGS. 1-8, respectively, and described in the following.

Figure 1:
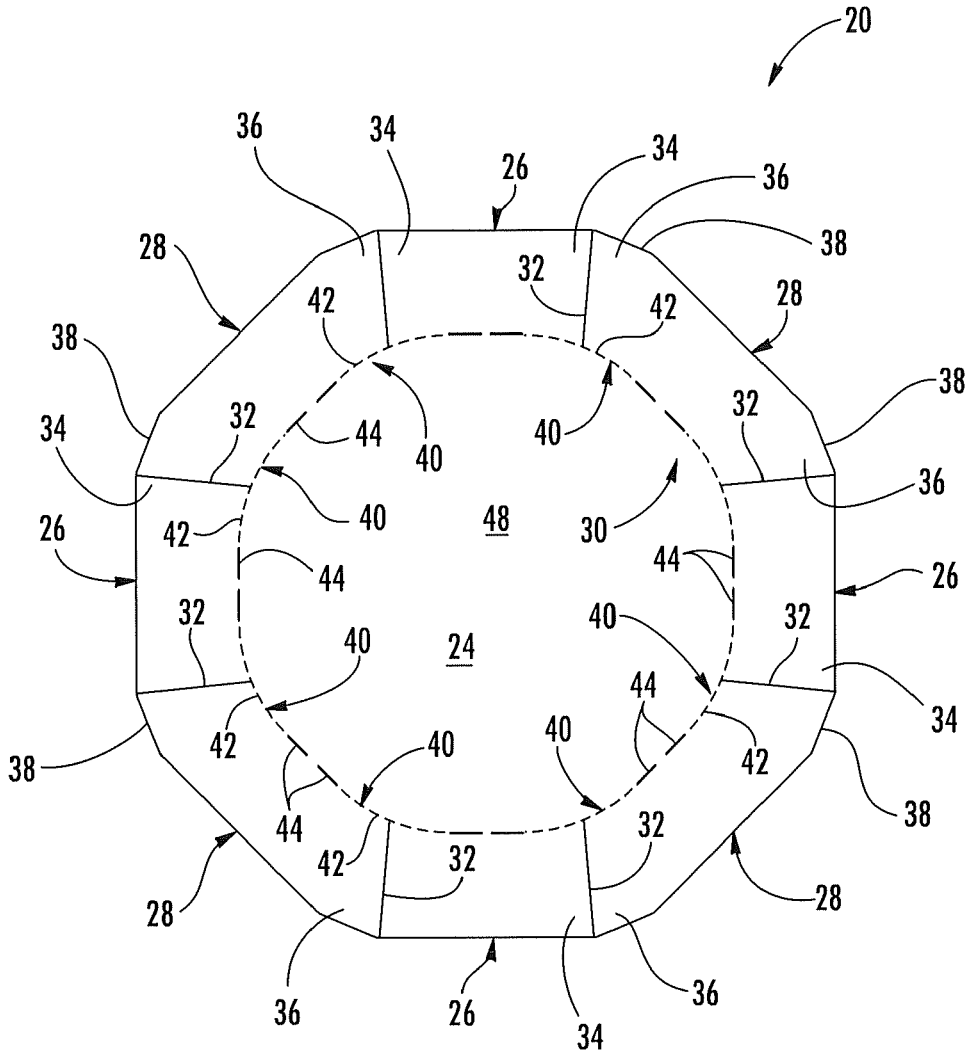
FIG. 1 is a schematic plan view of a flat blank, in accordance with a first embodiment of this disclosure.
Figure 2:
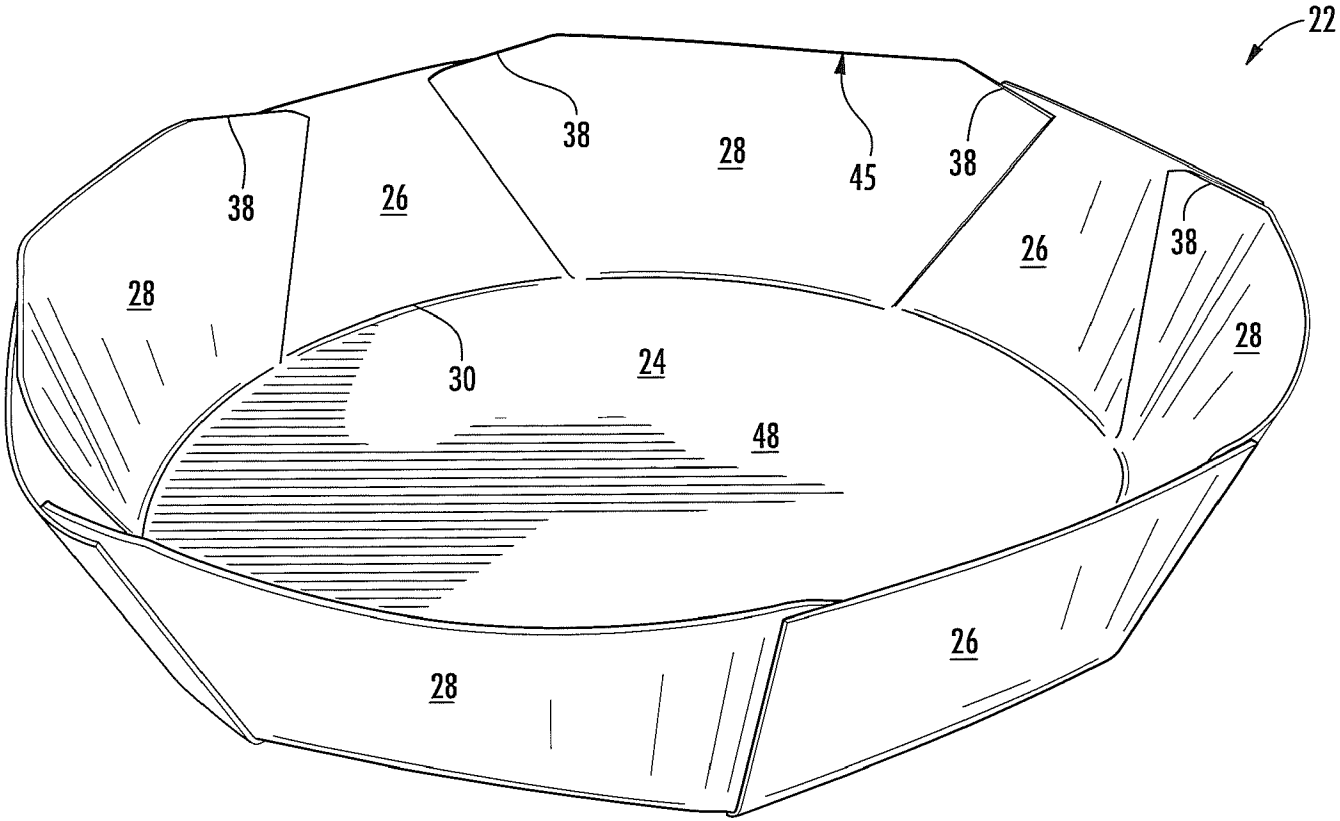
FIG. 2 generally is a top pictorial view of a substantially round tray erected from the blank of FIG. 1, in accordance with the first embodiment.
Figure 3:
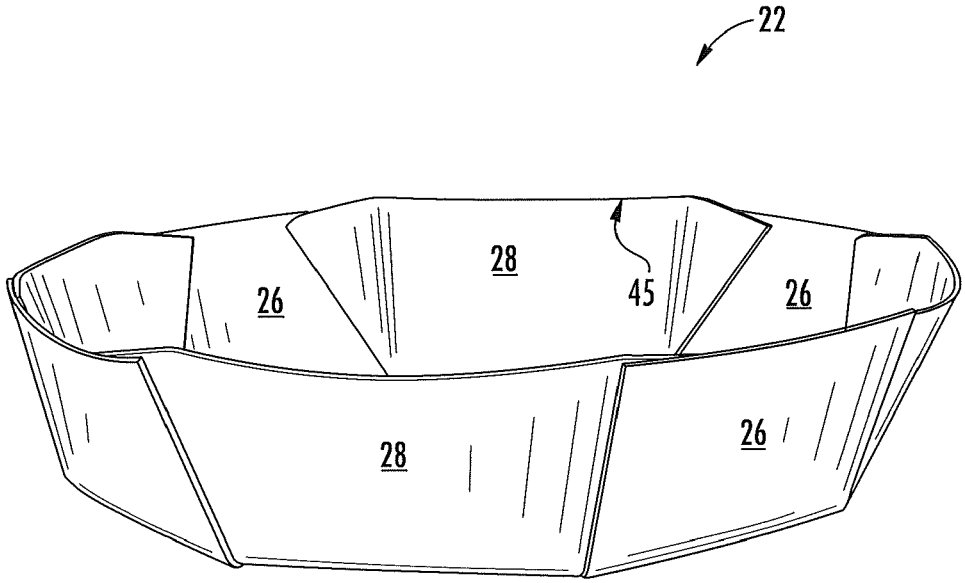
FIG. 3 generally is a side pictorial view of the tray of FIG. 2.
Figure 4:
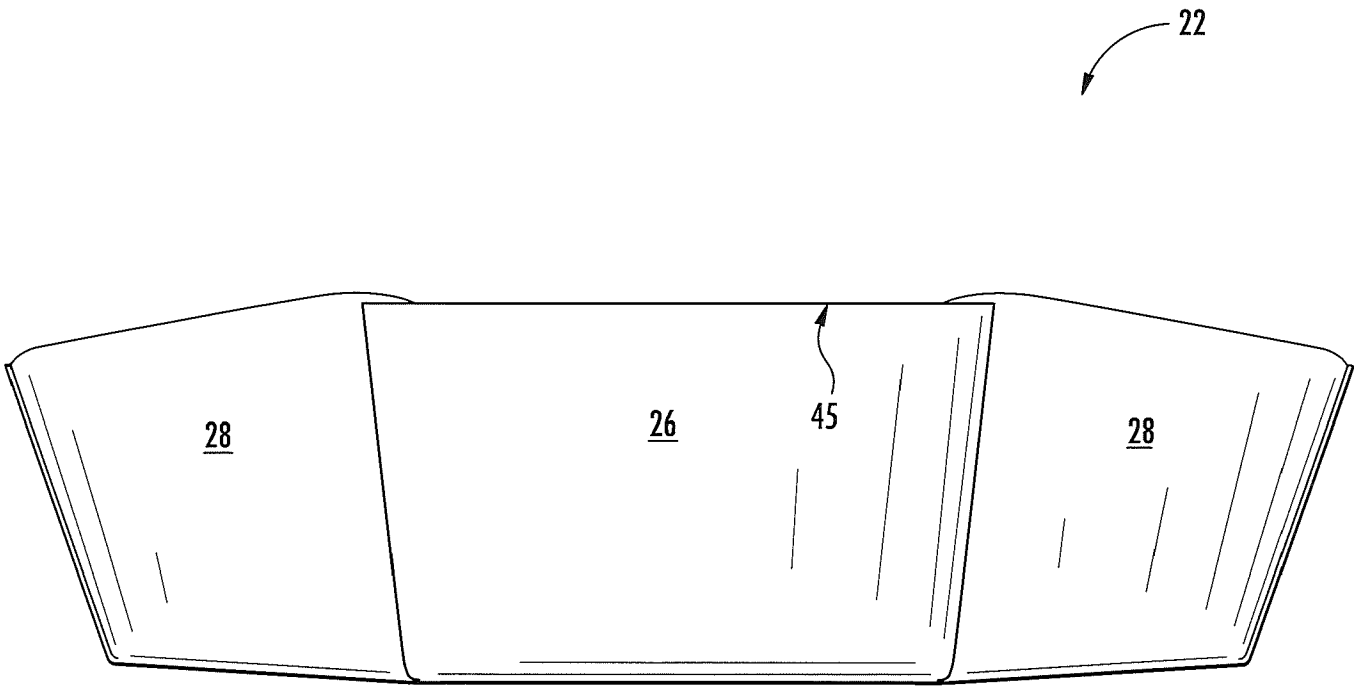
FIG. 4 is a side view of the tray of FIG. 2.
Figure 5:
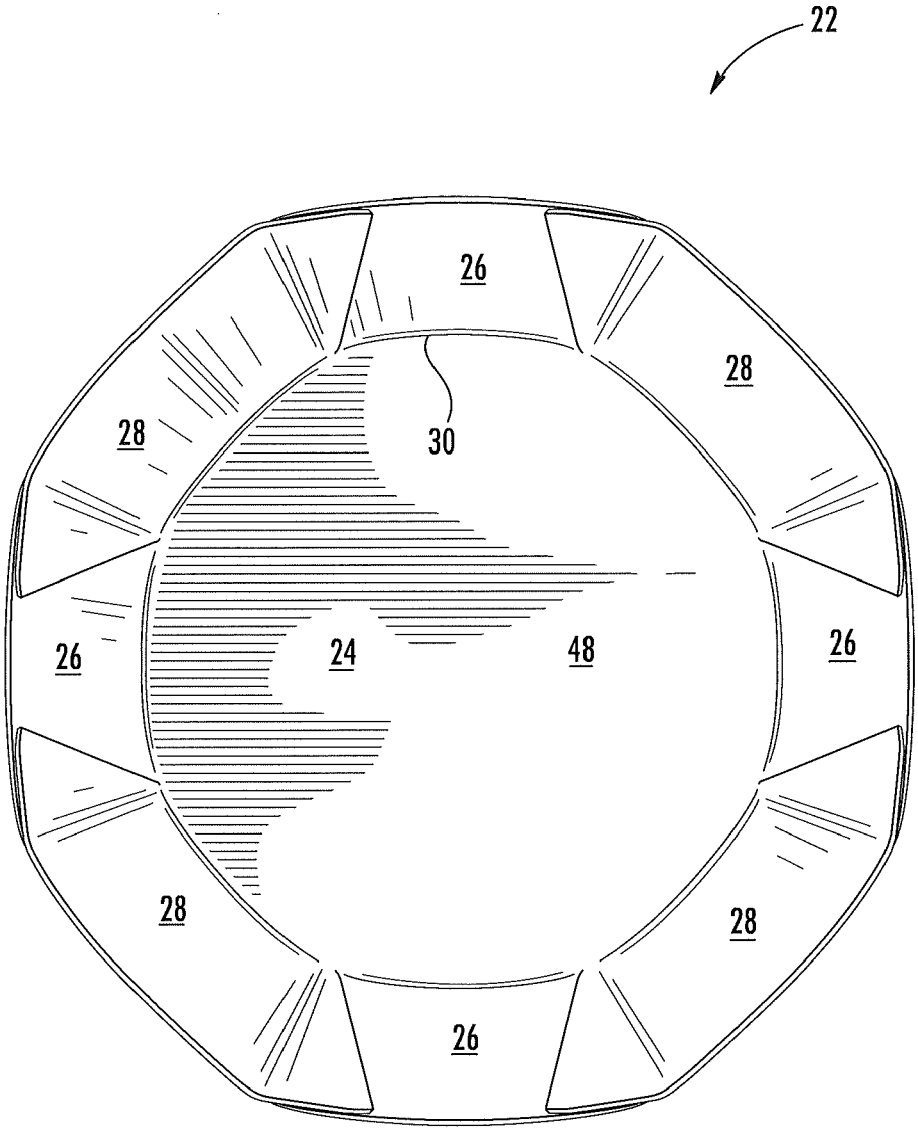
FIG. 5 is a top view of the tray of FIG. 2.
Figure 6:
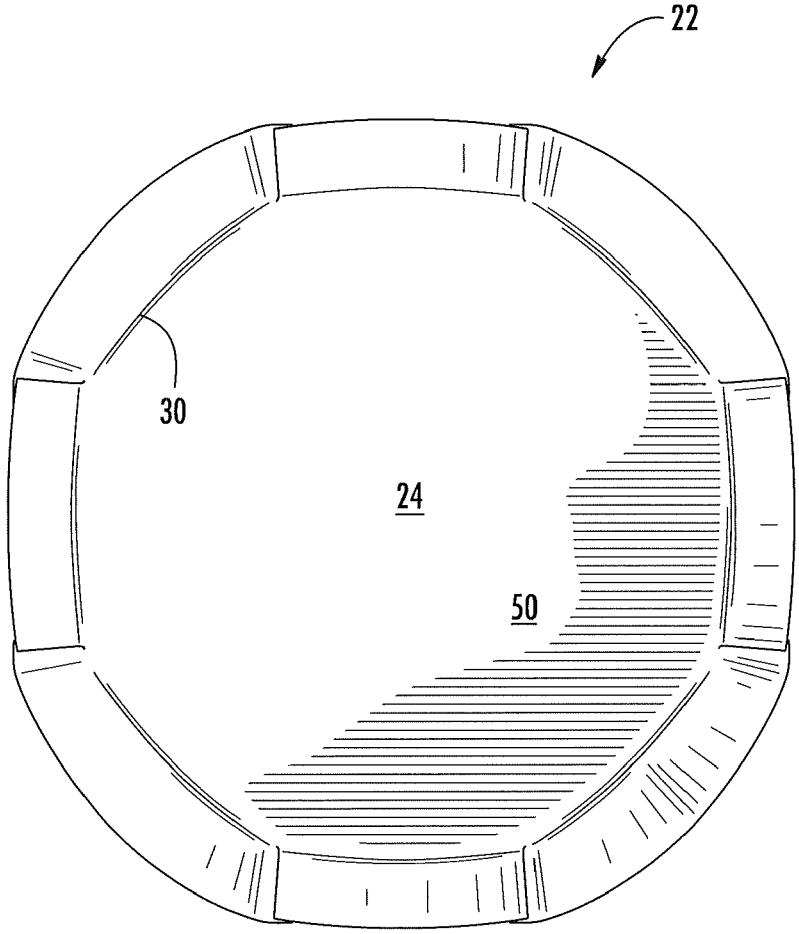
FIG. 6 is a bottom view of the tray of FIG. 2.

Referring primarily to FIGS. 1 and 2, the blank 20 and tray 22 each include a substantially round central panel 24 (e.g., base panel), and a series of flaps, or sidewalls connected to, and extending around, the periphery of the central panel. The flaps vary in the circumferential direction, so that the flaps alternate between relatively small flaps 26 and relatively large flaps 28. Whereas the blank 20 and tray 22 are shown as including eight flaps 26, 28, there may be more or less, and typically there are more than a total of four of the flaps, such as there being at least five, at least six, at least seven, at least eight, or more than eight of the flaps. Also, a variety of differently configured central panels and flaps are within the scope of this disclosure.

As best understood with reference to FIG. 1, the flaps 26, 28 may be defined by one or more lines of disruption, such as, but not limited to, cuts (e.g., slits 32 or cut outs) that extend outwardly from proximate a substantially annular fold or hinge line 30. In the first embodiment, there are eight of the slits 32 that extend outwardly from the hinge line 30 to the peripheral edge of the blank 20. The slits may be sufficiently narrow such that the flaps 26, 28 collectively extend all the way around the central panel 24. Alternatively, if the slits 32 are replaced with wide cuts or cutouts, then the flaps 26, 28 collectively may extend only partially around the central panel 24. Accordingly, the flaps 26, 28 collectively may be referred to as extending at least partially around the central panel 24.

The hinge line 30 is located at the substantially annular periphery, or substantially annular peripheral edge, of the central panel 24. As shown in FIG. 1, each of the relatively small flaps 26 has a curved inner side. Each of the relatively small flaps 26 may be characterized as being substantially rectangular (e.g., rectangular, or almost rectangular, such as a result of having a curved inner side). Therefore, for each of the relatively small flaps 26, each of the outer corners 34 of the small flap substantially defines a right angle. In contrast to the relatively small flaps 26, each of the relatively large flaps 28 is inwardly tapered. As a result, for each of the relatively large flaps 28, the outer edge of the large flap is longer than the inner edge of the large flap, so that each of the inner corners of the large flap defines an obtuse angle, and each of the outer corners 36 of the large flap defines an acute angle. Each of the outer edges/outer corners 36 of the large flaps 28 optionally includes one or more bevel edges 38, or the like, that define a chamfer and/or truncation, or the like. That is, each of the outer corners 36 of the large flaps 28 may be beveled, chamfered, truncated or otherwise shaped in a manner discussed in greater detail below. Accordingly and in accordance with the first embodiment, the blank 20 is substantially octagonal (e.g., octagonal, or octagonal except for each of the outer corners 36 of the large flaps 28 being somewhat beveled, chamfered, truncated, or the like).

In accordance with the first embodiment, the hinge line 30 may be characterized as being a substantially continuous, substantially annular line of disruption that extends substantially all the way around the central panel 24; and the hinge line may also be characterized as comprising a series of segments 40 (e.g., hinge or fold lines) that are spaced apart from one another and generally arranged end-to-end with respect to one another. Each segment 40 of the hinge line 30 includes a central portion 42 and opposite end sections 44. Only a few of the central portions 42 and end sections 44 are identified with their reference numerals in FIG. 1 in order to simplify FIG. 1. The central portions 42 are schematically illustrated by dashed lines in FIG. 1 to distinguish them from the end sections 44. For each segment 40 of the hinge line 30, the central portion 42 is a curved score line, and the end sections 44 are substantially straight slits. For each segment 40 of the hinge line 30, the slit end sections 44 are spaced apart from one another, extend obliquely to one another, and are connected to one another by the central portion 42 of the segment. Adjacent slits/end sections 44 of different segments 40 are spaced apart from one another. Alternatively, the hinge line 30 may be one or more lines of disruption of any other suitable type and arrangement. For example, the hinge line 30 may alternatively be a continuous, annular score line. As another alternative, the hinge line 30 may be omitted from the blank 20, and the hinge line 30, or the like, may only be formed as a result of the tray 22 being erected.

With the segments 40 of the hinge line 30 defined as discussed above, the flaps 26, 28 are respectively foldably connected to the central panel 24 by the segments, or more specifically each of the flaps is respectively foldably connected to the central panel 24 by adjacent halves of the segments. Similarly, the substantially annular peripheral edge of the central panel 24 may be characterized as including a series of peripheral edges respectively extending end-to-end, wherein the flaps 26, 28 may be characterized as being respectively connected to the peripheral edges. For example, each of the peripheral edges of the central panel may be characterized as extending between inner ends of adjacent slits 32.

An example of a method of erecting the blank 20 into the tray 22 is described in the following, in accordance with the first embodiment. Each flap 26, 28 includes opposite side margins that extend outwardly from the inner edge of the flap to the outer edge of the flap. The flaps 26, 28 are folded upwardly and inwardly about the hinge line 30 so that side margins of adjacent flaps overlap. As a result, the flaps 26, 28 extend around the interior space of the tray 22. In the fully erected tray 22, the upwardly extending flaps 26, 28 typically extend obliquely, namely obtusely, with respect to the inner surface 48 of the central panel 24, so that the flaps extend upwardly and outwardly from the central panel, and the resulting trays 22 may be nested together in a stack.

As best understood with reference to FIGS. 2-8, the outer corners 36 (FIG. 1) of the large flaps 28 are positioned inwardly of, and respectively overlap, the outer corners 34 (FIG. 1) of the small flaps 26, and each of the overlapping side margins of the flaps are fastened together, such as with adhesive material (not shown) or by way of any other suitable feature(s) for fastening. The overlapping side margins of the flaps 26, 28 are in opposing face-to-face configuration, or more specifically in opposing face-to-face contact, with one another. On the other hand, when the overlapping side margins of the flaps 26, 28 are fastened together with a layer of adhesive material interposed therebetween, the overlapping side margins of the flaps 26, 28 may be characterized as being in substantially opposing face-to-face configuration, or in substantially opposing face-to-face contact, with one another.

Alternatively, the outer corners 36 (FIG. 1) of the large flaps 28 may be positioned outwardly of the outer corners 34 (FIG. 1) of the small flaps 26. While the tray 22 is in its normal upright configuration, the amount of overlap between the overlapping side margins of the flaps 26, 28 typically increases in the upward direction. In the tray 22, the bevel edges 38 (FIGS. 1 and 2) of the large flaps 28 respectively cooperate with (are substantially aligned with) the outer edges of small flaps 26 in a manner that seeks to provide a substantially smooth and/or slightly undulating upper edge/rim 45 of the tray, although other configurations are within the scope of this disclosure.

In accordance with the first embodiment, the overall curvature of the hinge line 30, the curvature of the segments 40 of the hinge line 30, the curvature of the central portions 42 of the segments 40 of the hinge line 30, the angles defined by the bevel edges 38 and/or the configuration of other features may be selected so that the erected tray 22 is a substantially round tray. However, one or more of the features of the blank 20 and/or tray 22 may be varied so that trays of other embodiments may be shaped differently, such that this disclosure is not intended to be limited to substantially round trays. That is, aspects of this disclosure are applicable to a variety of differently shaped trays.

In the first embodiment, the flaps 26, 28 of the blank 20 are absent of any lines of disruption such as hinge or fold lines. Similarly, the tray 22 may be configured so that the sidewalls 26, 28 of the tray are absent of any lines of disruption such as hinge or fold lines. Alternatively, the flaps 26, 28 and/or sidewalls may include lines of disruption such as hinge or fold lines.

Figure 7:
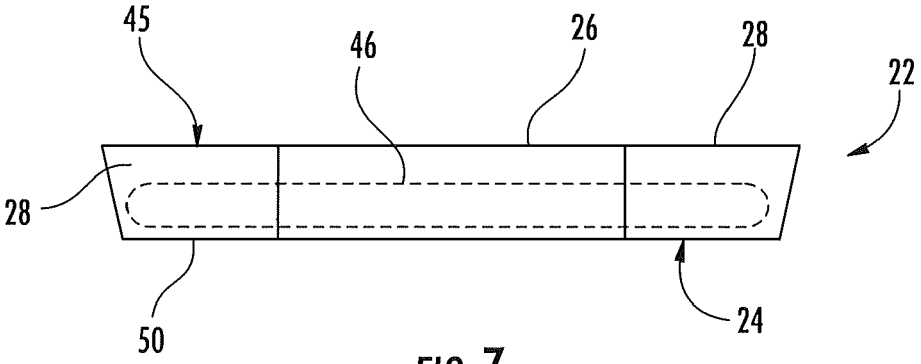
FIG. 7 is a schematic side elevation view of the tray of FIG. 2 containing food, wherein the food is hidden from view and shown by dashed lines.

An example of a method of using the tray 22 is described in the following, in accordance with the first embodiment. FIG. 7 is a schematic side elevation view of the tray 22 containing food 46. That is, the food 46 is in the interior space of the tray 22. For example and not limitation, the food 46 may be a substantially round food item, such as a pizza, hamburger, donut, cookie, or the like, so that the food may be securely contained in the substantially round tray 22. More generally, the food 46 may be of any shape and/or type that is typically contained in a tray, and if desired the shape of the tray 22 may be modified to at least generally conform to the size and shape of a wide variety of differently sized and shaped food items.

In FIG. 7, the bottom surface of the food 46 is supported by (e.g., in face-to-face contact with) the inner surface 48 (FIGS. 1, 2 and 5) of the central panel 24. As apparent from FIG. 7, the flaps 26, 28 extend around and higher than the food 46. Therefore, the food 46 is hidden from view in FIG. 7, and the food is schematically illustrated by dashed lines in FIG. 7. The tray 22 containing the food 46 may be closed with a cover or lid and/or the tray containing the food may be contained within an enclosure (not shown), such as a carton, an overwrap of film, or any other suitable enclosure.

Figure 8:
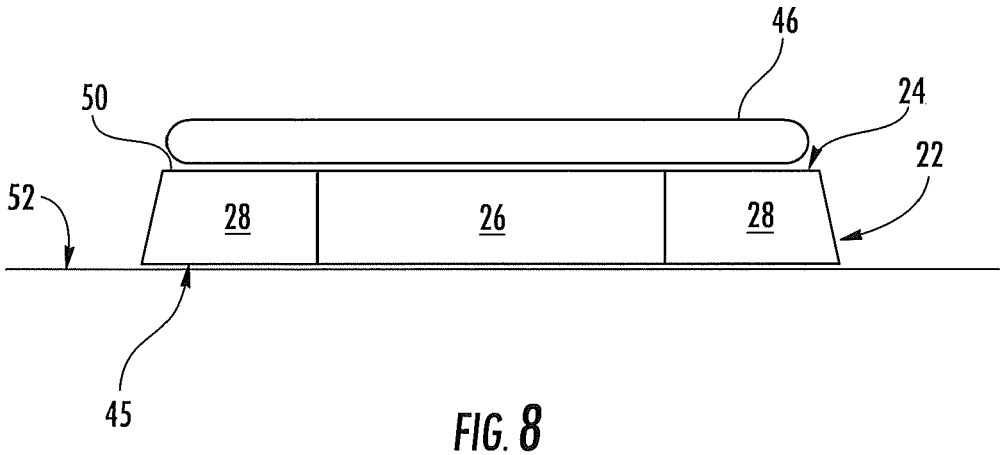
FIG. 8 is a schematic side elevation view of the tray of FIG. 2 in an inverted configuration and supporting the food.

FIG. 8 is a schematic side elevation view of the tray 22 in an inverted configuration and supporting the food 46. In FIG. 8, the bottom surface of the food 46 is supported by (e.g., in face-to-face contact with) the outer surface 50 of the central panel 24, and the rim 45 of the tray 22 is upon and being supported by a support surface 52. The support surface 52 may be any suitable support surface, such as a table top, counter top, or the top of a turntable or other supporting surface in a microwave oven. When the tray 22 is in the inverted configuration, the interior space of the tray 22 may function, for example, as an air-filled insulating gap between the support surface 52 and the food 46/central panel 24. Having such an insulating gap may be advantageous while the inverted tray 22 is supporting food 46 being heated by microwave energy within a microwave oven. For example, the insulating gap may seek to keep heat energy from being disadvantageously transferred away from the food to the floor or turntable of the microwave oven. In addition, microwave energy may be able to propagate through the insulating gap to advantageously reach the food 46 from below. Alternatively, the food 46 may be heated while the tray 22 and food are configured as shown in FIG. 7.

Further regarding the configuration shown in FIG. 8, one or more supporting legs (not shown) may optionally be defined in a central portion of the central panel 24 by lines of disruption. The supporting legs may be in the form of tabs or flaps that are struck (e.g., punched out) from the central panel 24 so that the supporting legs extend downwardly from the central panel and engage the support surface 52 to provide increased support for the food 46, such as when the food is relatively heavy (e.g., a frozen pizza). For example, each support leg may be defined by a slit or tear line extending from one end of a fold line to an opposite end of the fold line. There may be more or less than four of the supporting legs in the form of tabs or flaps, and the group of supporting legs may be are arranged in a circular pattern in the central panel 24 for being folded down after removing the product food 46 from the interior space of the tray 22, so that the supporting legs span between the central panel 24 and the support surface 52 while the tray is in the inverted configuration shown in FIG. 8. When included in the tray 22, the supporting legs are for helping to support the food 46. The supporting legs may be omitted, or they may be included, depending upon a variety of factors, such as the size of the tray 22 and the weight of the food 46.

The blank 20 and tray 22 may be constructed of any suitable material, such as, but not limited to, paperboard, cardboard, corrugated cardboard, or the like. More specifically, the blank 20 may typically be constructed of paperboard. Paperboard is ordinarily of a caliper such that it is heavier and more rigid than ordinary paper, and lighter and less rigid than cardboard. The paperboard may be coated with a clay coating, or the like. The clay coating may be printed over with product, advertising, price-coding, and/or other information. The blank 20 may be coated with a varnish or any other suitable coating to protect any information printed on the blank. The blank 20 may also be coated with, for example, moisture barrier and/or stain masking layer(s). Other features may be printed, coated, laminated and/or otherwise joined to or associated with the blank 20. For example and as discussed in greater detail below, the blank 20 may include microwave interactive material. The microwave interactive material may be any suitable microwave interactive material that is in any suitable arrangement. For example, the microwave interactive material may more specifically be in the form of a susceptor, as discussed in greater detail below.

A second embodiment of this disclosure is like the first embodiment, except for variations noted and variations that will be apparent to one of ordinary skill in the art. Due to the similarity, components of the second embodiment that are at least similar to and/or function in at least some ways similarly to corresponding components of the first embodiment have reference numbers incremented by one hundred.

Figure 9:
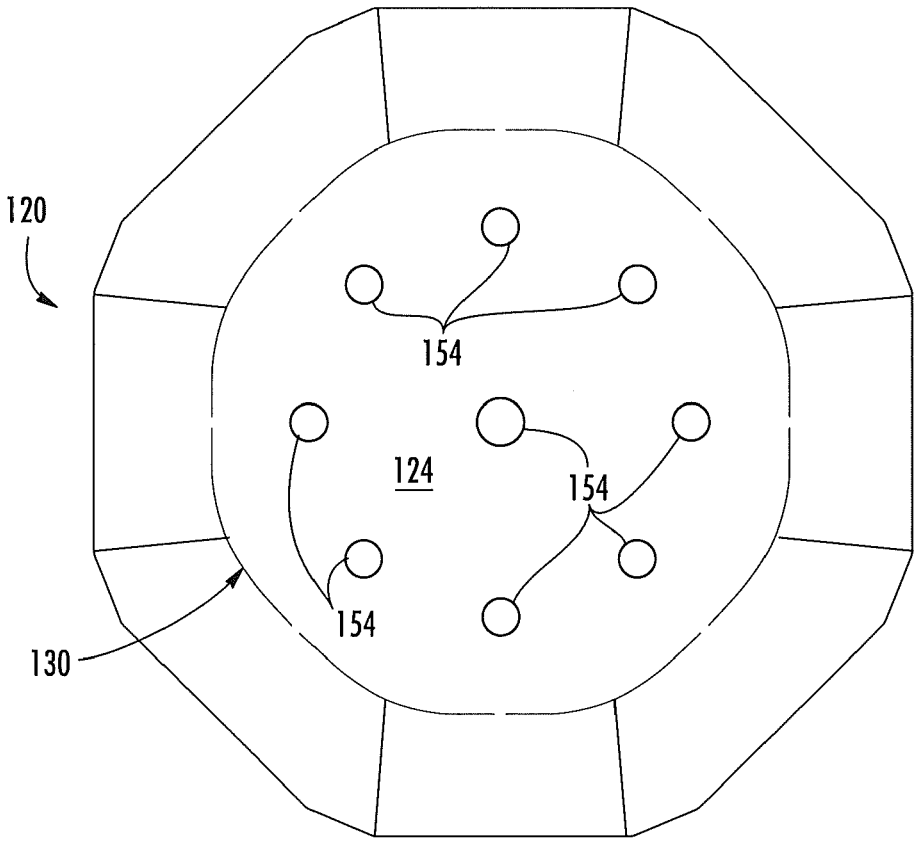
FIG. 9 is a schematic plan view of a flat blank, in accordance with a second embodiment of this disclosure.

As best understood with reference to the blank 120 of the second embodiment shown in FIG. 9, round holes 154 extend through the central panel 124 of both the blank and the tray of the second embodiment. For example, the holes 154 may allow for venting of moisture while the inverted tray of the second embodiment is supporting food being heated by microwave energy within a microwave oven. The holes 154 may be in a wide variety of different sizes, shapes and patterns. A variety of differently shaped trays are within the scope of this disclosure. Similarly, a variety of differently sized trays are within the scope of this disclosure.

A third embodiment of this disclosure is like the first and second embodiments, except for variations noted and variations that will be apparent to one of ordinary skill in the art. Due to the similarity, components of the third embodiment that are at least similar to and/or function in at least some ways similarly to corresponding components of the second embodiment have reference numbers incremented by one hundred with respect to the second embodiment, and incremented by two hundred with respect to the first embodiment.

Figure 10:
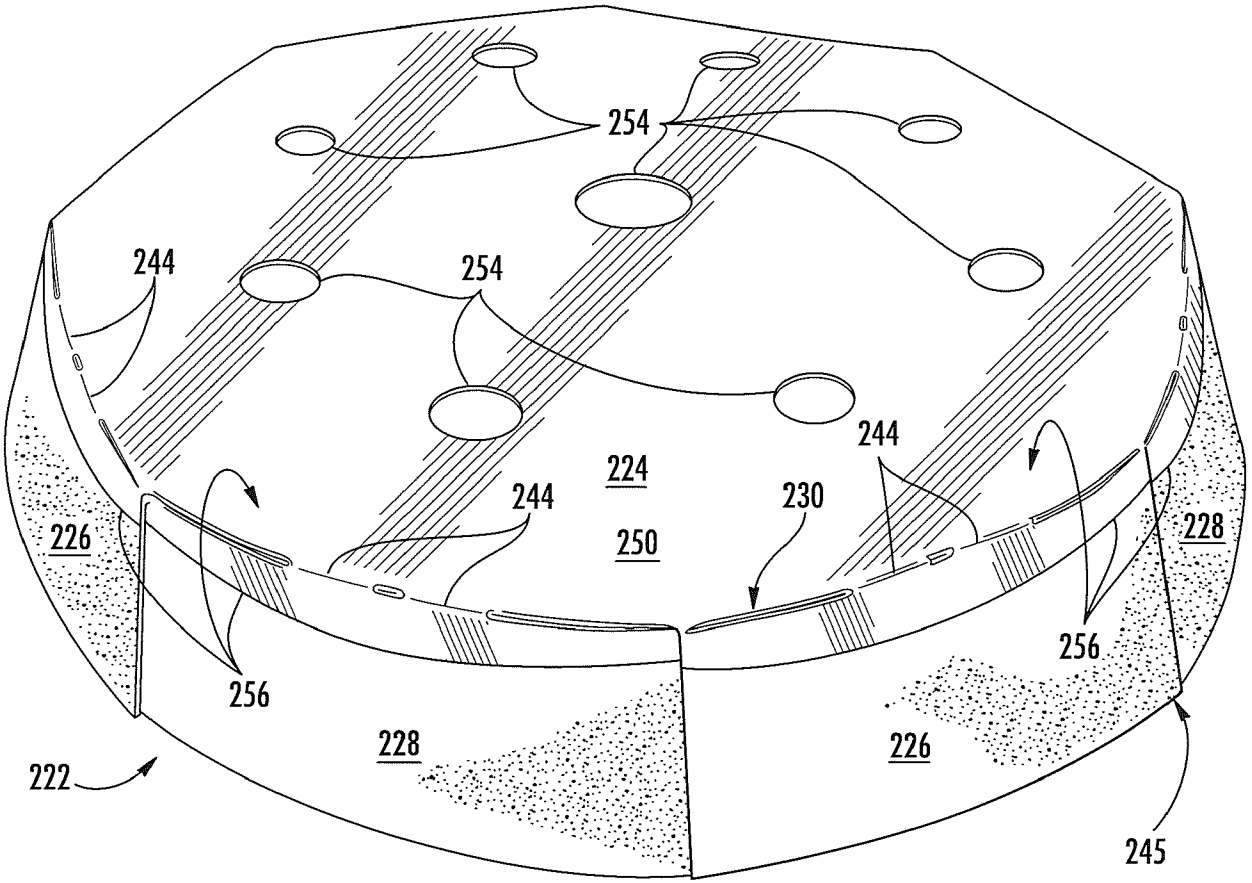
FIG. 10 is a bottom pictorial view of a tray, in accordance with a third embodiment of this disclosure.

As best understood with reference to the inverted tray 222 of the third embodiment shown in FIG. 10, the tray includes (e.g., supports and has mounted thereon) microwave interactive material. The microwave interactive material may be any suitable microwave interactive material that is in any suitable arrangement. For example, the microwave interactive material may more specifically be in the form of a susceptor 256. As shown in FIG. 10 for example and not for purposes of limiting the scope of this disclosure, the susceptor 256 covers, forms and/or is part of the outer surface 250 of the central panel 224, and it also partially covers, forms and/or is part of the outer surfaces of the flaps 26, 28; and the holes 254 extend through the susceptor 256. The susceptor 256 may be any suitable type of susceptor, and it may be in any suitable arrangement. The microwave interactive material (e.g., susceptor 256) may be characterized by any of the aspects described in the following.

Any of the various blanks (e.g., blanks 20, 120), trays (e.g., trays 22, 222) or other constructs of this disclosure may optionally include one or more features that alter the effect of microwave energy during the heating or cooking of a food item that is associated with the tray or other construct. For example, the blank, tray or other construct may be formed at least partially from one or more microwave energy interactive elements (hereinafter sometimes referred to as "microwave interactive elements") that promote heating, browning and/or crisping of a particular area of the food item (e.g., food 46 in FIGS. 7 and 8), shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor (e.g., susceptor 256), the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure (e.g., see the holes 254 in FIG. 10), or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

It will be noted that any of such discontinuities or apertures in a susceptor may comprise a physical aperture or void (e.g., see the holes 254 in FIG. 10) in one or more layers or materials used to form the structure or construct, or may be a non-physical "aperture". A non-physical aperture is a microwave energy transparent area that allows microwave energy to pass through the structure without an actual void or hole cut through the structure. Such areas may be formed by simply not applying microwave energy interactive material to the particular area, by removing microwave energy interactive material from the particular area, or by mechanically deactivating the particular area (rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., microwave energy inactive). While both physical and non-physical apertures allow the food item to be heated directly by the microwave energy, a physical aperture also provides a venting function to allow steam or other vapors or liquid released from the food item to be carried away from the food item.

In accordance with the above-discussed embodiments of this disclosure, a hinge line (e.g., the hinge lines 30, 130, 230, which may be referred to as fold lines) can be any at least somewhat line-like arranged, although not necessarily straight, form of weakening that facilitates folding therealong. More specifically, but not for the purpose of narrowing the scope of this disclosure, conventional hinge lines include: a crease, such as formed by folding; a score line, such as formed with a blunt scoring knife, or the like, which creates a crushed portion in the material along the desired line of weakness; a slit that extends partially into and/or completely through the material along the desired line of weakness, and/or a series of spaced apart slits that extend partially into and/or completely through the material along the desired line of weakness; or various combinations of these features.

Directional references (e.g., upper, lower, upward, downward, left, right, leftward, rightward, top, bottom, above, below, vertical, horizontal, clockwise, and counterclockwise) have been used in this disclosure for ease of understanding and not for the purpose of limiting the scope of this disclosure. Also, in considering the scope of this disclosure, each of the features of this disclosure may be considered in isolation, and in various combinations and subcombinations.

The above examples are in no way intended to limit the scope of the present invention. It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A tray, comprising:

a base panel having a periphery;

a plurality of sidewalls extending upwardly and outwardly from the periphery of the base panel, and extending around an interior of the tray, wherein the plurality of sidewalls comprise more than four sidewalls that are respectively adjacent to one another, each sidewall of the plurality of sidewalls includes opposite first and second marginal portions extending outwardly from the base panel, for each adjacent pair of sidewalls of the plurality of sidewalls, the first marginal portion of a first sidewall of the adjacent pair of sidewalls is in an overlapping relationship with, and is fastened to, the second marginal portion of a second sidewall of the adjacent pair of sidewalls, and the fastened-together first and second sidewalls extend obliquely to the base panel so that an opening to the interior of the tray is larger than the base panel;

an outwardly bulging first convex fold line connecting an outwardly bulging convex inner edge of the first sidewall of a first of the adjacent pairs of sidewalls to the periphery of the base panel, the outwardly bulging first convex fold line extending from the first marginal portion of the first sidewall of the first adjacent pair of sidewalls to the second marginal portion of the first sidewall of the first adjacent pair of sidewalls; and an outwardly bulging second convex fold line connecting an outwardly bulging convex inner edge of the second sidewall of the first adjacent pair of sidewalls to the periphery of the base panel, the outwardly bulging second convex fold line extending from the first marginal portion of the second sidewall of the first adjacent pair of sidewalls to the second marginal portion of the second sidewall of the first adjacent pair of sidewalls.

2. The tray according to claim 1, wherein the tray is substantially round.

3. The tray according to claim 1, wherein each of the sidewalls is formed from a respective flap.

4. The tray according to claim 1, further comprising microwave interactive material on at least one of the base panel and the plurality of sidewalls.

5. The tray according to claim 1, wherein:

the periphery of the base panel comprises a plurality of peripheral edges;

the plurality of peripheral edges comprises more than four peripheral edges that are each convex; and the sidewalls are respectively connected to the convex peripheral edges.

6. The tray according to claim 5, wherein: the plurality of peripheral edges of the base panel comprises eight outwardly bulging convex peripheral edges; and the plurality of sidewalls comprises eight sidewalls.

7. The tray according to claim 1, wherein:

the first and second sidewalls are configured differently from one another, comprising the first sidewall being smaller than the second sidewall; and the second marginal portion of the second sidewall is positioned between the interior and the first marginal portion of the first sidewall.

8. The tray according to claim 7, wherein:

the first sidewall is substantially rectangular; and the second sidewall is substantially inwardly tapered.

9. The tray according to claim 7, wherein the second sidewall has opposite outer corners that each define acute angles.

10. The tray according to claim 7, wherein the second sidewall has opposite outer corners, and an outer corner of the outer corners is chamfered.

11. A blank for being erected into a tray, the blank comprising:

a central panel having a periphery;

a plurality of flaps extending outwardly from the periphery of the central panel, wherein the plurality of flaps comprise more than four flaps, each flap of the plurality of flaps includes opposite first and second marginal portions extending outwardly from the central panel, the flaps comprise first flaps and second flaps that are configured differently from one another, the flaps circumferentially alternate between the first flaps and the second flaps so that each adjacent pair of the flaps includes both one of the first flaps and one of the second flaps, and in each of the adjacent pairs of flaps, the first marginal portion of the first flap of the adjacent pair of flaps is configured for being in an overlapping relationship with the second marginal portion of the second flap of the adjacent pair of flaps when the blank is erected into the tray; and an outwardly bulging first convex fold line connecting an outwardly bulging convex inner edge of the first flap of a first of the adjacent pairs of flaps to the periphery of the central panel, the outwardly bulging first convex fold line extending from the first marginal portion of the first flap of the first adjacent pair of flaps to the second marginal portion of the first flap of the first adjacent pair of flaps; and an outwardly bulging second convex fold line connecting an outwardly bulging convex inner edge of the second flap of the first adjacent pair of flaps to the periphery of the central panel, the outwardly bulging second convex fold line extending from the first marginal portion of the second flap of the first adjacent pair of flaps to the second marginal portion of the second flap of the first adjacent pair of flaps.

12. The blank according to claim 11, wherein:

each of the first flaps is substantially rectangular; and each of the second flaps is substantially inwardly tapered.

13. The blank according to claim 11, wherein each of the second flaps has opposite outer corners that each define acute angles.

14. The blank according to claim 11, wherein each of the second flaps has opposite outer corners, and an outer corner of the outer corners is chamfered.

15. The blank according to claim 11, wherein:

the periphery of the central panel comprises a plurality of peripheral edges;

the plurality of peripheral edges comprises more than four peripheral edges that are each convex; and the sidewalls are respectively connected to the convex peripheral edges.

16. The blank according to claim 15, wherein:

the plurality of peripheral edges of the central panel comprises eight outwardly bulging convex peripheral edges; and the plurality of flaps comprises eight flaps.

17. A blank for being erected into a carton, the blank comprising:

a central panel having a periphery;

a plurality of flaps extending at least partially around the periphery of the central panel, the plurality of flaps extending outwardly from the periphery of the central panel, the plurality of flaps comprising more than four flaps, and each flap of the plurality of flaps comprises opposite first and second outwardly extending edges extending outwardly from the central panel; and a plurality of fold lines respectively connecting the flaps to the periphery of the central panel, the plurality of fold lines comprising an outwardly bulging first convex fold line connecting an outwardly bulging convex inner edge of a first flap of the plurality of flaps to the periphery of the central panel, the outwardly bulging first convex fold line extending substantially from the first outwardly extending edge of the first flap substantially to the second outwardly extending edge of the first flap, an outwardly bulging second convex fold line connecting an outwardly bulging convex inner edge of a second flap of the plurality of flaps to the periphery of the central panel, the outwardly bulging second convex fold line extending substantially from the first outwardly extending edge of the second flap substantially to the second outwardly extending edge of the second flap, an outwardly bulging third convex fold line connecting an outwardly bulging convex inner edge of a third flap of the plurality of flaps to the periphery of the central panel, the outwardly bulging third convex fold line extending substantially from the first outwardly extending edge of the third flap substantially to the second outwardly extending edge of the third flap, and an outwardly bulging fourth convex fold line connecting an outwardly bulging convex inner edge of a fourth flap of the plurality of flaps to the periphery of the central panel, the outwardly bulging fourth convex fold line extending substantially from the first outwardly extending edge of the fourth flap substantially to the second outwardly extending edge of the fourth flap.

18. The blank according to claim 17, wherein the blank is substantially octagonal.

19. The blank according to claim 17, comprising a plurality of outwardly extending slits, and the slits being respectively positioned between adjacent flaps of the plurality of flaps.

20. The blank according to claim 17, wherein the plurality of fold lines together form a substantially annular hinge line.

21. The blank according to claim 17, wherein:

the plurality of fold lines together form a substantially annular hinge line comprising a series of segments that are spaced apart from one another and generally arranged end-to-end with respect to one another; and each segment includes slits and a roundedly curved score positioned between the slits.

22. The blank according to claim 21, wherein for each segment, the slits of the segment are spaced apart from one another and extend obliquely with respect to one another.

23. The blank according to claim 17, wherein:

the periphery of the central panel comprises a plurality of convex peripheral edges;

the plurality of convex peripheral edges of the central panel comprises more than four convex peripheral edges; and the flaps are respectively foldably connected to the convex peripheral edges of the central panel.

24. The blank according to claim 23, wherein:

the plurality of convex peripheral edges of the central panel comprises eight outwardly bulging convex peripheral edges; and the plurality of flaps comprises eight flaps.

25. The blank according to claim 17, wherein the second flap is configured differently from the first flap.

26. The blank according to claim 11, wherein a flap of the first flaps is smaller than a flap of the second flaps.

27. The blank according to claim 11, wherein each flap of the first flaps is smaller than each flap of the second flaps.

28. The blank according to claim 16, wherein:

a flap of the first flaps is substantially rectangular; and a flap of the second flaps is substantially inwardly tapered.

29. The blank according to claim 16, wherein:

each flap of the first flaps is substantially rectangular; and each flap of the second flaps is substantially inwardly tapered.

30. The blank according to claim 16, wherein a flap of the second flaps has opposite outer corners that each define acute angles.

31. The blank according to claim 16, wherein a flap of the second flaps has opposite outer corners, and an outer corner of the outer corners is chamfered.

32. The tray according to claim 1, comprising:

an outwardly bulging third convex fold line connecting an outwardly bulging convex inner edge of the first sidewall of a second of the adjacent pairs of sidewalls to the periphery of the base panel, the outwardly bulging third convex fold line extending from the first marginal portion of the first sidewall of the second adjacent pair of sidewalls to the second marginal portion of the first sidewall of the second adjacent pair of sidewalls; and an outwardly bulging fourth convex fold line connecting an outwardly bulging convex inner edge of the second sidewall of the second adjacent pair of sidewalls to the periphery of the base panel, the outwardly bulging fourth convex fold line extending from the first marginal portion of the second sidewall of the second adjacent pair of sidewalls to the second marginal portion of the second sidewall of the second adjacent pair of sidewalls.

33. The tray according to claim 32, comprising:

an outwardly bulging fifth convex fold line connecting an outwardly bulging convex inner edge of the first sidewall of a third of the adjacent pairs of sidewalls to the periphery of the base panel, and the outwardly bulging fifth convex fold line extending from the first marginal portion of the first sidewall of the third adjacent pair of sidewalls to the second marginal portion of the first sidewall of the third adjacent pair of sidewalls;

an outwardly bulging sixth convex fold line connecting an outwardly bulging convex inner edge of the second sidewall of the third adjacent pair of sidewalls to the periphery of the base panel, and the outwardly bulging sixth convex fold line extending from the first marginal portion of the second sidewall of the third adjacent pair of sidewalls to the second marginal portion of the second sidewall of the third adjacent pair of sidewalls;

an outwardly bulging seventh convex fold line connecting an outwardly bulging convex inner edge of the first sidewall of a fourth of the adjacent pairs of sidewalls to the periphery of the base panel, and the outwardly bulging seventh convex fold line extending from the first marginal portion of the first sidewall of the fourth adjacent pair of sidewalls to the second marginal portion of the first sidewall of the fourth adjacent pair of sidewalls; and an outwardly bulging eighth convex fold line connecting an outwardly bulging convex inner edge of the second sidewall of the fourth adjacent pair of sidewalls to the periphery of the base panel, and the outwardly bulging eighth convex fold line extending from the first marginal portion of the second sidewall of the fourth adjacent pair of sidewalls to the second marginal portion of the second sidewall of the fourth adjacent pair of sidewalls.

34. The blank according to claim 11, comprising:

an outwardly bulging third convex fold line connecting an outwardly bulging convex inner edge of the first flap of a second of the adjacent pairs of flaps to the periphery of the central panel, the outwardly bulging third convex fold line extending from the first marginal portion of the first flap of the second adjacent pair of flaps to the second marginal portion of the first flap of the second adjacent pair of flaps; and an outwardly bulging fourth convex fold line connecting an outwardly bulging convex inner edge of the second flap of the second adjacent pair of flaps to the periphery of the central panel, the outwardly bulging fourth convex fold line extending from the first marginal portion of the second flap of the second adjacent pair of flaps to the second marginal portion of the second flap of the second adjacent pair of flaps.

35. The blank according to claim 34, comprising:

an outwardly bulging fifth convex fold line connecting an outwardly bulging convex inner edge of the first flap of a third of the adjacent pairs of flaps to the periphery of the central panel, and the outwardly bulging fifth convex fold line extending from the first marginal portion of the first flap of the third adjacent pair of flaps to the second marginal portion of the first flap of the third adjacent pair of flaps;

an outwardly bulging sixth convex fold line connecting an outwardly bulging convex inner edge of the second flap of the third adjacent pair of flaps to the periphery of the central panel, and the outwardly bulging sixth convex fold line extending from the first marginal portion of the second flap of the third adjacent pair of flaps to the second marginal portion of the second flap of the third adjacent pair of flaps;

an outwardly bulging seventh convex fold line connecting an outwardly bulging convex inner edge of the first flap of a fourth of the adjacent pairs of flaps to the periphery of the central panel, and the outwardly bulging seventh convex fold line extending from the first marginal portion of the first flap of the fourth adjacent pair of flaps to the second marginal portion of the first flap of the fourth adjacent pair of flaps; and an outwardly bulging eighth convex fold line connecting an outwardly bulging convex inner edge of the second flap of the fourth adjacent pair of flaps to the periphery of the central panel, and the outwardly bulging eighth convex fold line extending from the first marginal portion of the second flap of the fourth adjacent pair of flaps to the second marginal portion of the second flap of the fourth adjacent pair of flaps.

36. The blank according to claim 17, wherein the plurality of fold lines comprises:

an outwardly bulging fifth convex fold line connecting an outwardly bulging convex inner edge of a fifth flap of the plurality of flaps to the periphery of the central panel, and the outwardly bulging fifth convex fold line extending substantially from the first outwardly extending edge of the fifth flap substantially to the second outwardly extending edge of the fifth flap;

an outwardly bulging sixth convex fold line connecting an outwardly bulging convex inner edge of a sixth flap of the plurality of flaps to the periphery of the central panel, and the outwardly bulging sixth convex fold line extending substantially from the first outwardly extending edge of the sixth flap substantially to the second outwardly extending edge of the sixth flap;

an outwardly bulging seventh convex fold line connecting an outwardly bulging convex inner edge of a seventh flap of the plurality of flaps to the periphery of the central panel, and the outwardly bulging seventh convex fold line extending substantially from the first outwardly extending edge of the seventh flap substantially to the second outwardly extending edge of the seventh flap; and an outwardly bulging eighth convex fold line connecting an outwardly bulging convex inner edge of an eighth flap of the plurality of flaps to the periphery of the central panel, and the outwardly bulging eighth convex fold line extending substantially from the first outwardly extending edge of the eighth flap substantially to the second outwardly extending edge of the eighth flap.

37. The tray according to claim 1, wherein the first marginal portion of the first sidewall being fastened to the second marginal portion of the second sidewall comprises adhesive material connecting the first marginal portion of the first sidewall to the second marginal portion of the second sidewall.

* * * * *